US006059611A

United States Patent [19]

Davis et al.

[11] Patent Number: 6,059,611

[45] Date of Patent: May 9, 2000

[54] HIGH TEMPERATURE ELECTRICAL CONNECTOR ASSEMBLY

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 09/071,950

[22] Filed: May 4, 1998

[51] Int. Cl.[7] ..... H01R 23/70

[52] U.S. Cl. ..... 439/637

[58] Field of Search ..... 439/60, 108, 637, 439/495, 496, 839, 328, 909

[56] References Cited

U.S. PATENT DOCUMENTS

| | | | |
|---|---|---|---|
| 3,212,051 | 10/1965 | Stark | 439/717 |
| 3,296,363 | 1/1967 | Laudig et al. | 174/89 |
| 3,611,249 | 10/1971 | Lovrenich | 439/78 |
| 4,629,281 | 12/1986 | Kruger | 439/791 |
| 4,679,888 | 7/1987 | Williams | 439/883 |
| 4,718,854 | 1/1988 | Capp et al. | 439/63 |
| 5,122,064 | 6/1992 | Zarreii | 439/65 |
| 5,198,279 | 3/1993 | Beinhaur et al. | 428/99 |
| 5,310,352 | 5/1994 | Mroczkowski et al. | 439/76 |
| 5,344,334 | 9/1994 | Laub et al. | 439/331 |
| 5,364,287 | 11/1994 | Weber | 439/358 |
| 5,482,474 | 1/1996 | Yohn et al. | 439/79 |
| 5,493,085 | 2/1996 | Kolberg et al. | 200/51 R |
| 5,496,189 | 3/1996 | Over et al. | 439/321 |

OTHER PUBLICATIONS

Olin Brass Mills Catalog, pp. 22–23 and 29, Sep. 1970.

U.S. Patent Application Serial No. 09/005,279 filed Jan. 9, 1998; (Abstract and Drawings only included).

*Primary Examiner*—Michael L. Gellner

*Assistant Examiner*—Barry M. L. Standig

[57] ABSTRACT

An electrical connector assembly (40) in which the elements (42, 44) providing electrical contact are separate from the element insuring sufficient normal contact force. The assembly is capable of operating at elevated temperatures by utilizing a stainless steel spring member (46) to provide the contact force, since stainless steel maintains its resiliency at high temperatures. The conducting elements (42, 44) are formed of a conductive material which maintains its conductivity over a wide range of temperatures. The assembly holds the conducting elements in a stack so that only a single spring member is required.

15 Claims, 3 Drawing Sheets

HIGH TEMPERATURE ELECTRICAL CONNECTOR ASSEMBLY

BACKGROUND OF THE INVENTION

This invention relates to electrical connector assemblies and, more particularly, to such an assembly which is capable of operating in a high temperature environment.

Present day copiers include a heater for fusing toner to paper. One such type of heater comprises an elongated substrate such as a circuit board having a resistor on one side and two thermistors on the other side each having a circuit pad for establishing electrical connections with circuits of a connector. Such a heater requires on each end of the substrate a three position connector assembly terminated to wires. Within each connector assembly, the contact member associated with the resistor must be capable of conducting a high current and withstanding a high temperature, while the contact members associated with the thermistors will see control voltages only, although these contact members will also be exposed to elevated temperatures.

Within a typical connector assembly, a spring force is generally provided to insure adequate contact between mated elements. A problem arises in selecting a material for use as a contact member in a high temperature application. This is because a material which has high conductivity, as required for the contact member, loses its resiliency (i.e., it softens) at high temperatures, while a material which maintains its resiliency at high temperatures has low conductivity. It would a therefore a be desirable to provide an electrical connector assembly which, taken as a whole, provides adequate spring force and conductivity over a broad range of temperatures.

SUMMARY OF THE INVENTION

According to the present invention, there is provided an electrical connector assembly having individual contact members used solely for electrical connection purposes and a separate spring member to insure adequate contact. The inventive assembly includes a housing arranged so that at least the power contact member and the spring member are stacked, with the spring member so situated that it functions to press the contact section of the power contact member against the substrate to interconnect the contacting surfaces. Preferably, additional contact members are disposed in the housing to engage the circuit pads for the thermistors, and may be disposed beneath the substrate such that the spring member also urges the substrate against the additional contact members to establish interconnections therewith. To achieve proper operation over a broad range of temperatures, the contact members are illustratively formed of silver plated brass, which retains its conductivity, and the spring member is illustratively formed of stainless steel, which retains its resiliency.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 3:
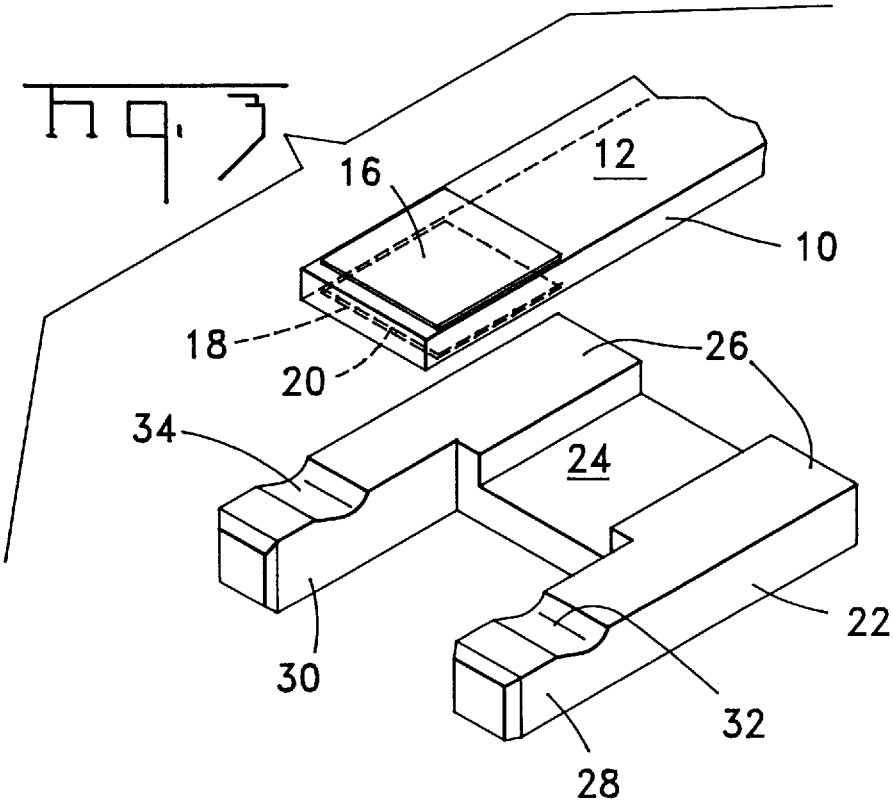
FIG. 3 is an exploded isometric view showing an end of a heater element substrate and a plastic retainer therefor, which together are insertable into the inventive connector assembly housing.

Referring now to the drawings, an elongated substrate 10 used in a copier heater has a resistor (not shown) on its upper surface 12 and a pair of thermistors (not shown) on its lower surface 14. A conductive contact pad 16 on the upper surface 12 provides a connection to the resistor, and conductive contact pads 18, 20 (see FIG. 3) on the lower surface 14 provide connections to the thermistors. The arrangement of contact pads 16, 18, 20 is repeated at the other end of the substrate 10. The electrical connector assembly to be described hereinafter was developed to provide connections to the contact pads 16, 18, 20, with the connection to the contact pad 16 being a high current, high power, connection and the connections to the contact pads 18, 20 being for control voltages. In a particular application, the substrate 10 is nine inches long, 0.210 inches wide and 0.040 inches thick. The heater operates at 242° C. at 800 watts at 7 amperes. Thus, the inventive connector assembly is required to withstand very high temperatures.

Each end of the substrate 10 is supported on a respective insulative retainer 22, formed of a high temperature plastic material. The retainer 22 includes a support surface 24 which is recessed from the upper surface 26 of the retainer 22 by approximately the thickness of the substrate 10. The substrate 10 is secured to the support surface 24, rearwardly of the contact pads 16, 18, 20, by adhesive or screws or in any other suitable manner. Extending forwardly of the support surface 24 and flanking the forward end of the substrate 10 are a pair of fingers 28, 30, each of which has a concavity 32, 34, respectively, which are used for detent purposes, as will be described hereinafter. When the substrate 10 is secured to the retainer 22, the front end of the substrate 10 is recessed slightly behind the front ends of the fingers 28, 30 to prevent damage to the substrate 10 during its mating with the connector assembly, as will be described. The front end shape of the substrate 10/retainer 22 provides polarization to prevent the substrate 10 being inserted upside down into the mating connector assembly.

The inventive connector assembly, designated generally by the reference numeral 40, includes a power contact member 42, a pair of signal contact members 44, a spring member 46 and a housing 48. The power contact member 42 is preferably stamped from a sheet of silver plated brass and terminates an appropriate wire (not shown) by crimping an insulation barrel 50 and a wire barrel 52 to the wire, as is conventional in the art. The power contact member 42 is adapted to engage the upper contact pad 16. Accordingly, forward of the wire terminating barrels 50, 52, the contact member 42 is formed with a generally planar body portion 54 with three downwardly extending domed projections 56. The projections 56 are for the purpose of providing contact points with the upper contact pad 16 and are situated at respective vertices of a triangle so that the contact points of the projections 56 with the upper contact pad 16 lie in a plane. Accordingly, there is no "wobble" of the contact member 42 on the upper contact pad 16. The contact member 42 is further formed at its leading edge with an upwardly ramped portion 58, which provides a camming surface for mating with the substrate 10, as will be described. The contact member 42 is also formed with a pair of opposed lateral rails 60 which, as will be described in full detail hereinafter, cooperate with complementary structure of the housing 48 for guiding the contact member 42 into the housing 48 and for restricting its movement thereafter. Finally, the contact member 42 is formed with a lanced projection 62 extending upwardly and rearwardly from the body portion 54. As will be described hereinafter, the function of the projection 62 is to prevent inadvertent removal of the contact member 42 from the housing 48.

Each contact member 44 is adapted to contact a respective one of the lower contact pads 18, 20. Since the contact member 44 only conducts control signals, it does not need to be as robust as the contact member 42. Preferably, the contact member 44 is stamped from a sheet of silver plated brass and includes, at its rear end, an insulation barrel 64 and a wire barrel 66 for crimpingly terminating an appropriate wire (not shown), as known in the art. Forward of the wire barrel 66, the contact member 44 is formed generally as a half cylinder with an upwardly extending domed projection 68 near its forward end for contacting the respective lower contact pad 18, 20. Forward of the projection 68, the contact member 44 is formed with a downwardly directed ramped portion 70 which acts as a camming surface for cooperating with the substrate 10, as will be described. A pair of extensions 72 below and forward of the ramped portion 70 are used to maintain the position of the contact member 44 when assembled to the housing 48, as will be described. The contact member 44 is further formed with a lanced projection 74 which extends laterally and rearwardly to prevent inadvertent removal of the contact member 44 from the housing 48, as will be described. Preferably, lanced projections 74 extend outwardly from both sides of the contact member 44 so that the identical contact member can be utilized in both contact positions even if only one housing wall is provided to engage only one of the lanced projections 74 upon insertion.

Figure 4:
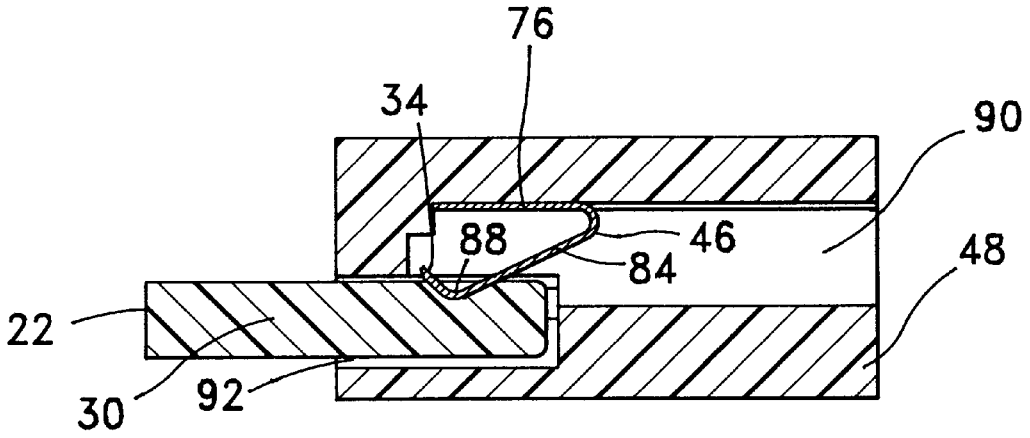
FIG. 4 is a cross sectional view, taken along the line 4—4 in FIG. 2, of a fully assembled and mated inventive connector assembly.
Figure 5:
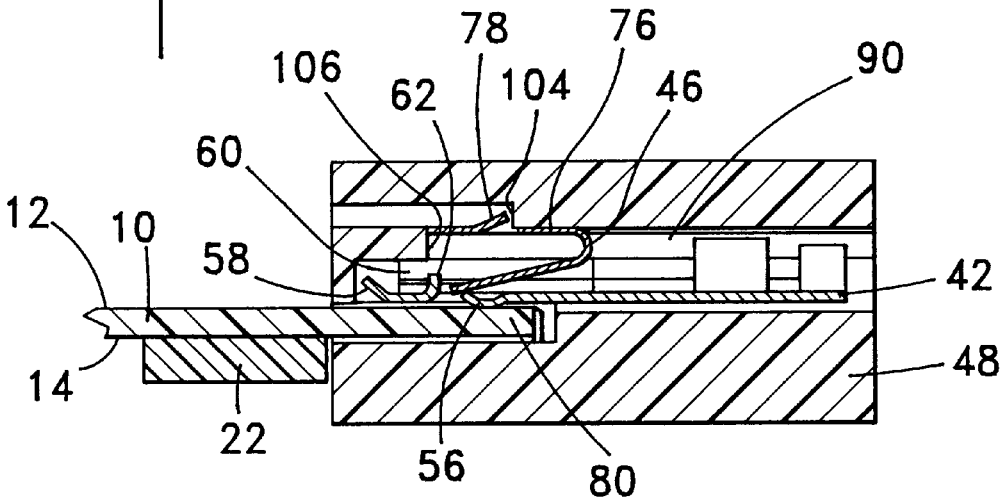
FIG. 5 is a cross sectional view, taken along the line 5—5 in FIG. 2, of a fully assembled and mated inventive connector assembly.

The spring member 46 is preferably stamped from a sheet of stainless steel so that it retains its resiliency over the wide range of temperatures to which it is exposed. The spring member 46 is formed with an upper generally planar body portion 76 having a lanced projection 78 extending rearwardly and upwardly and which functions to prevent inadvertent removal of the spring member 46 from the housing 48, as will be described. The spring member 46 further includes a central spring finger 80 extending downwardly and forwardly from the rear of the body portion 76. As will be described, the spring finger 80 performs two functions. The first function is to provide normal (i.e., orthogonal) contact forces for the contact members 42, 44 with the contact pads 16, 18, 20 by biasing the contact member 42 against the substrate 10 and, consequently, the substrate 10 against the contact members 44. The second function is to interfere with the projection 62 of the contact member 42 to prevent removal of the contact member 42 from the housing 48 (see FIG. 5). The spring member 46 is further formed with a pair of detent fingers 82, 84, which flank the spring finger 80 and extend downwardly and forwardly is from the rear of the body portion 76. At their forward ends, the detent fingers 82, 84 are bent upwardly to provide camming surfaces for the fingers 28, 30 of the retainer 22. As will be described, the bend 86 of the detent finger 82 is adapted to engage the concavity 32 of the retainer finger 28 and the bend 88 of the detent finger 84 is adapted to engage the concavity 34 of the retainer finger 30 (see FIG. 4).

Figure 1:
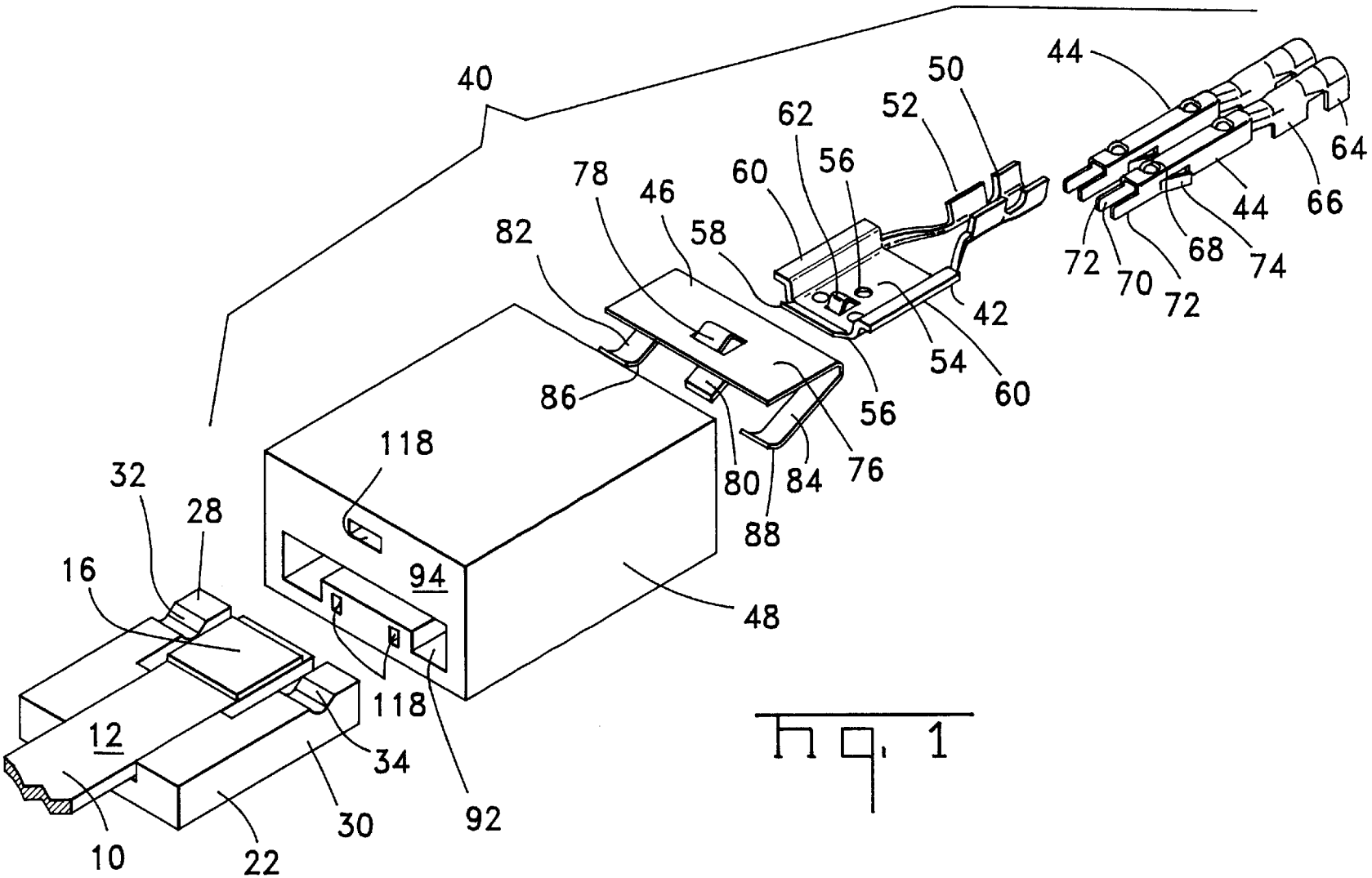
FIG. 1 is an exploded isometric view of an exemplary electrical connector assembly constructed according to the present invention.
Figure 2:
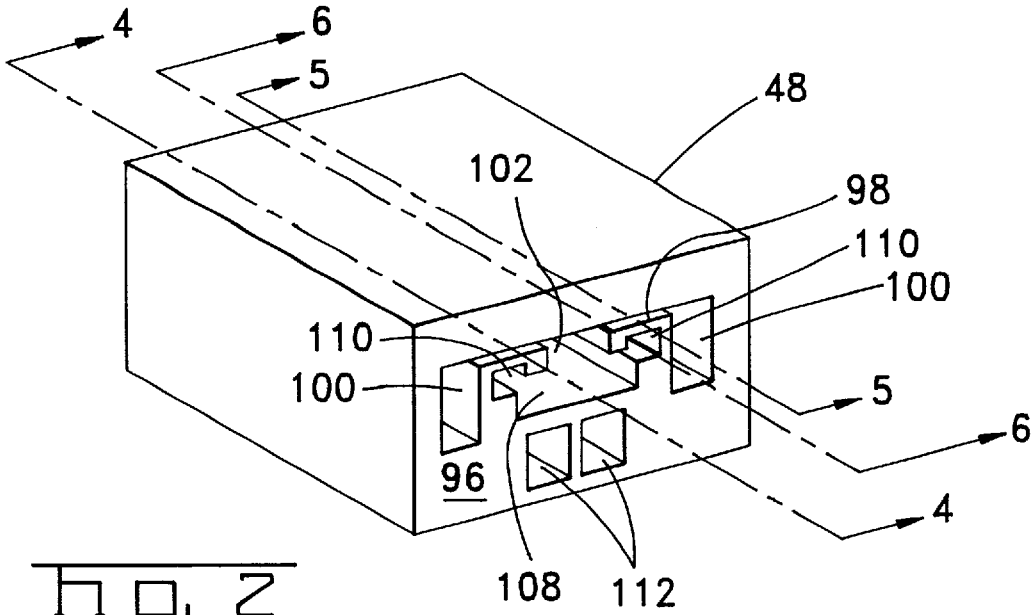
FIG. 2 is a rear isometric view of the housing of the connector assembly shown in FIG. 1.
Figure 6:
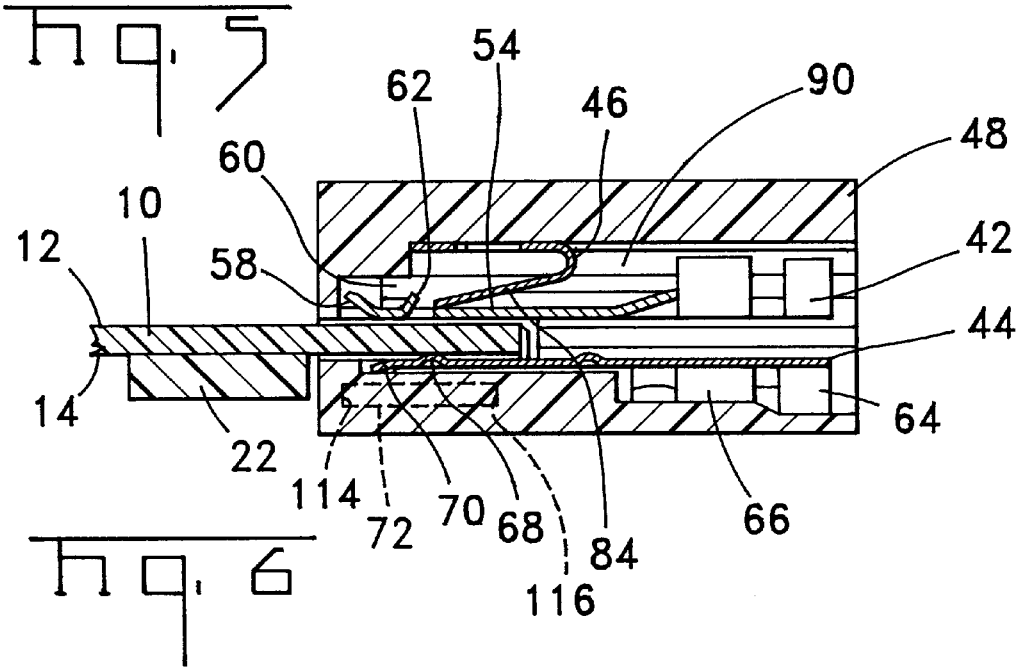
FIG. 6 is a cross sectional view, taken along the line 6—6 in FIG. 2, of a fully assembled and mated inventive connector assembly.

The housing 48 is block-like in appearance and is preferably molded from a high temperature plastic material so as to have insulative properties and not be affected by the elevated temperatures to which it is subjected. The housing 48 is formed with an internal cavity 90 adapted to hold in a stack the contact members 44, the substrate 10 above the contact members 44, the contact member 42 above the substrate 10, and the spring member 46 above the contact member 42, as best shown in FIG. 6. To provide access to the internal cavity 90, as shown in FIG. 1 the housing 48 is formed with a front channel 92 extending inwardly from the front face 94 for receiving the substrate 10/retainer 22 into the cavity 90. The shape of the channel 92 is complementary to the shape of the substrate 10/retainer 22 and provides a polarizing feature so that the substrate 10/retainer 22 can only be inserted into the housing 48 in the correct orientation.

The spring 46 is assembled to the housing 48 by inserting it into the housing 48 from the rear face 96 thereof. Thus, the housing 48 is formed with a rear channel including a generally flat portion 98 for receiving the body portion 76 of the spring member 46, a pair of downwardly extending channel portions 100 for receiving the detent fingers 82, 84, and a downwardly extending central portion 102 for receiving the spring finger 80. The spring member 46 is moved forwardly into the cavity 90 until the projection 78 passes the wall 104 (FIG. 5) and the forward end of the body portion 76 abuts against the wall 106. The wall 106 prevents further forward movement of the spring member 46 and the wall 104 prevents rearward movement of the spring 46 due to interference with the projection 78.

After the spring member 46 is installed, the contact member 42 is then assembled to the housing 48 through the channel 108 which includes lateral portions 110 for receiving the lateral rails 60. The lateral channel portions 110 provide clearance for the lateral channel rails 60 to allow the contact member 42 to move upwardly when engaging the substrate 10. The contact member 42 is inserted into the internal cavity 90 until the lanced projection 62 passes the forward end of the spring finger 80, which prevents subsequent inadvertent removal of the contact member 42.

The channels 112 allow the contact members 44 to be assembled to the housing 48. The contact member 44 is moved inwardly into the housing 48 until the forward ends of the extensions 72 abut the wall 114 (see FIG. 6). The wall 114 is at the forward end of a small recess in the internal cavity 90 which cooperates with the extensions 72 to prevent the forward end of the contact member 44 from moving upwardly. The lateral lanced projection 74 of the contact member 44 interferes with the wall 116 to prevent subsequent inadvertent removal of the contact member 44. As shown in FIG. 1, the front face 94 of the housing 48 has channels 118. The channels 118 are the result of the use of core pins for molding the internal cavity 90 with the interference walls 104 and 116. These channels 118 also serve the purpose of gaining access to the projections 78 and 74 so that the connector assembly 40 can be disassembled.

After the connector assembly 40 is assembled with the spring member 46 and the contact members 42, 44, it may be mated with the substrate 10/retainer 22. As the substrate 10/retainer 22 is inserted from the front face 94 of the housing 48, the forward ramped portion 58 of the contact member 42 is cammed upwardly by the leading end of the substrate 10, and raises the front end of the contact member 42, allowing full insertion of the substrate 10. The upwardly ramped forward portions of the detent fingers 82, 84 similarly allow full of the retainer fingers 28, 30. When the substrate 10/retainer 22 is fully seated within the housing 48, the bends 86, 88 of the detent fingers 82, 84, respectively, engage the concavities 32, 34, respectively, of the retainer fingers 28, 30, so that a certain amount of force is required to remove the substrate 10/retainer 22. The spring finger 80 provides a normal force to the contact member 42 so that the contact member 42 engages the upper contact pad 16 on the substrate 10. This normal force is transmitted through the substrate 10 so that appropriate contact is maintained between the lower contact pads 18, 20 and the contact members 44. Thus, only a single spring is required to provide the necessary contact forces for all the contact members. Since the spring member 46 is formed of a material which retains its resiliency over a wide range of temperatures, contact is maintained at all such temperatures.

Accordingly, there has been disclosed an improved electrical connector assembly which is capable of operating over a wide range of temperatures. While an exemplary embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. An electrical connector assembly for providing electrical connections to a substrate having a conductive contact pad on an upper surface, comprising:

at least a first contact member for contacting the upper conductive contact pad;

a spring member including a body having a spring finger extending therefrom for engaging said first contact member; and an insulative housing having a front face and a rear face, said housing being formed with an internal cavity adapted to hold said first contact member overlying a substrate-receiving cavity portion and said body of said spring member above said first contact member with said spring finger extending downwardly and engaging said first contact member and resiliently biasing said first contact member downwardly, said housing being further formed with a front channel extending inwardly from said front face for receiving said substrate into said cavity beneath said first contact member;

whereby said spring finger provides normal contact forces for said at least a first contact member with said conductive contact pad.

2. The assembly according to claim 1 wherein said housing is further formed with a first rear channel extending inwardly from said rear face for receiving said first contact member into said cavity and a second rear channel extending inwardly from said rear face for receiving said spring member into said cavity.

3. The assembly according to claim 2 wherein:

said spring member includes a lanced projection extending upwardly and rearwardly for interference with a wall of said housing internal cavity to prevent removal of said spring member after insertion into said cavity; and said first contact member includes a lanced projection extending upwardly and rearwardly from a location forward of said spring finger for interference with said spring finger to prevent removal of said first contact member after insertion into said cavity.

4. The assembly according to claim 1 further comprising:

an insulative retainer for an end of said substrate including a support surface for said substrate rearwardly of said conductive contact pad and a pair of forwardly extending fingers flanking said substrate in the vicinity of said conductive contact pad, each of said fingers having a concavity on an upper surface;

wherein said housing internal cavity is further adapted to hold said retainer fingers below said spring member and said housing is formed with a pair of channels flanking said front channel and extending inwardly from said front face for receiving said fingers into said cavity; and wherein said spring member further includes a pair of detent fingers flanking said spring finger and each adapted to engage a respective concavity.

5. The assembly according to claim 1 wherein said first contact member has a generally planar body portion with three downwardly extending domed projections, each having at least one contact point thereon for contacting said upper conductive contact pad, the domed projections being situated at respective vertices of a triangle so that the contact points of said projections with said upper conductive contact pad lie in a plane.

6. The assembly according to claim 1 wherein:

said substrate supports a heating element;

said first contact is formed of a material having high conductivity over a broad range of temperatures; and said spring member is formed of a material having substantially uniform resiliency over a broad range of temperatures.

7. The assembly according to claim 6 wherein said spring member is formed of stainless steel.

8. The assembly according to claim 6 wherein said first contact member is formed of silver plated brass.

9. The assembly according to claim 1 wherein a forward end of said first contact member is formed with a camming surface cooperating with the forward end of said substrate to move said first contact member upwardly within said cavity as said substrate enters said cavity.

10. The assembly according to claim 9 wherein said first contact member is formed with a pair of opposed lateral rails cooperating with lateral channels of said housing internal cavity to maintain a selected angular orientation of said first contact member during and after said first contact member is installed in said cavity.

11. The assembly according to claim 1 wherein said substrate further has at least one conductive contact pad on a lower surface, the assembly further comprising:

at least a second contact member for contacting the lower conductive contact;

wherein the housing internal cavity is adapted to hold said second contact member below said substrate-receiving cavity portion.

12. The assembly according to claim 11 wherein said housing is further formed with a third rear channel extending inwardly from said rear face for receiving said second contact member into said cavity.

13. The assembly according to claim 12 wherein said second contact member includes a lanced projection extending laterally and rearwardly for interference with a wall of said housing internal cavity to prevent removal of said second contact member after insertion into said cavity.

14. The assembly according to claim 11 wherein a forward end of said second contact member is formed with a camming surface cooperating with a forward end of said substrate to move said second contact member downwardly within said cavity as said substrate enters said cavity.

15. The assembly according to claim 14 wherein said second contact member is formed with an extension forward of said camming surface to cooperate with a recess at a forward end of said housing internal cavity to prevent the forward end of said second contact member from lifting after said second contact member is installed in said cavity.

* * * * *